US006593556B1

(12) United States Patent
Kim

(10) Patent No.: US 6,593,556 B1
(45) Date of Patent: Jul. 15, 2003

(54) MICROWAVE OVEN AND METHOD OF CONTROLLING THE SAME

(75) Inventor: Jun-Beom Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/253,613

(22) Filed: Sep. 25, 2002

(30) Foreign Application Priority Data

Jun. 29, 2002 (KR) ..... 2002-37606

(51) Int. Cl.[7] ..... H05B 6/68

(52) U.S. Cl. ..... 219/702; 219/715; 219/719; 219/492; 99/325

(58) Field of Search ..... 219/702, 719, 219/704, 710, 715, 716, 494, 492; 99/325, 451

(56) References Cited

U.S. PATENT DOCUMENTS 4,918,276 A 4/1990 Oh ..... 219/10.55 M
5,367,145 A * 11/1994 Takgi ..... 219/494
5,545,881 A * 8/1996 Chai et al. ..... 219/719

FOREIGN PATENT DOCUMENTS

JP 61-268920 * 11/1986 ..... 219/716

* cited by examiner

*Primary Examiner*—Philip H. Leung

(57) ABSTRACT

A microwave oven accumulatively counts a cooking time by decreasing the cooking time where an actual cooking operation is not carried out, and various electrical parts, including a high voltage transformer, are cooled. The microwave oven increases the cooking time where a power relay of the microwave oven is actually driven and the cooking operation is carried out. Accordingly, the microwave oven counts the cooking time in consideration of cooking conditions. Additionally, the microwave oven decreases an output power level where the counted cooking time has reached a preset overheating prevention time, and compulsorily recovers the output power level to perform the remaining cooking operation where a cooling period has elapsed.

24 Claims, 4 Drawing Sheets

MICROWAVE OVEN AND METHOD OF CONTROLLING THE SAME

CROSS-REFERENCE TO RELATED APPLICATIONS

This application claims the benefit of Korean Patent Application No. 2002-37606 filed on Jun. 29, 2002, in the Korean Industrial Property Office, the disclosure of which is incorporated herein by reference.

BACKGROUND OF THE INVENTION

1. Field of the Invention

The present invention relates to a microwave oven, and a method of controlling the same, which controls the level of output power according to cooking times to prevent overheating of the microwave oven.

2. Description of the Related Art

Generally, microwave ovens are devices which heat/cook foods using microwaves. FIG. 1 shows a conventional microwave oven having a body 1 which defines an external shape of the microwave oven, a cooking chamber 5 which is formed in a left side of the body 1 and accommodates food therein, and a key input unit 9 which is installed in a right side of the body 1 and is used to input information including a cooking menu item, a cooking time, an output power level, and a cooking start instruction. A door 3 which opens/closes the cooking chamber 5 is attached to a portion of the body 1 using a hinge.

The conventional microwave oven having the above-described construction is provided with a function which controls the level of its output power. In the conventional microwave oven, the output power level is increased/decreased by controlling a switching-on time, for which power is supplied to a high voltage transformer, and a switching-off time, for which the supply of power to the high voltage transformer is intercepted. That is, the output power level can be decreased by shortening the switching-on time in a predetermined period for a power relay disposed between a power terminal and the high voltage transformer. Accordingly, the switching-off time is relatively lengthened. In contrast, the output power level can be increased by lengthening the switching-on time for the power relay. In response, the switching-off time is relatively shortened.

In the conventional microwave oven, where a magnetron is continuously driven for an extended time, by supplying power to the high voltage transformer, overheating is generated in various electrical parts including the high voltage transformer. Accordingly, the output power level is controlled according to cooking times. For example, to prevent overheating in the conventional microwave oven, a cooking time is counted during a cooking operation, and the power relay is controlled to decrease the output power level where the counted cooking time reaches a preset time. The remaining cooking operation is performed while the decreased output power level is maintained.

However, the conventional microwave oven uniformly counts a cooking time regardless of a practical aspect of the cooking operation during the performance of the cooking operation by the driving of the magnetron, and controls the output power level on the basis of the counted cooking time. Consequently, a cooking time is increased even where a user manipulates a pause key so as to temporarily stop the cooking operation, and in response, a control unit turns off the power relay according to the operation of the pause key.

Where the increased cooking time reaches a predetermined time, the control unit decreases the output power level by shortening a switching-on time of the power relay so as to prevent overheating, and performs the remaining cooking operation using the decreased output power level.

Due to the above-mentioned operations, the output power level set by the user or automatically set by a control program cannot be maintained, and the remaining cooking is carried out using the decreased output power level. As such, the conventional microwave oven cannot perform an optimal cooking operation with respect to a corresponding cooking menu item. Therefore, a cooking performance is decreased, and in most cases, the entire cooking time is increased.

That is, during an operation in which electrical parts, including the high voltage transformer, are cooled by external air, like in the case of the pausing of the cooking operation, even though it is inappropriate to increase a cooking time, the conventional microwave oven considers this cooling stage as a part of an entire cooking operation and accumulatively increases the cooking time.

Additionally, where a user manipulates a cancel key to cancel a corresponding cooking operation in progress, the control unit clears a counted cooking time as an initial value of 0, and then counts a new cooking time from the initial value of 0 according to newly set cooking conditions. Therefore, where the user repeatedly performs the setting of new cooking conditions and manipulates the cancel key, the electrical parts, including the high voltage transformer, are under substantially the same operating conditions as they would be under successive operations. However, since a cooking time is cleared due to the manipulation of the cancel key, an overheating prevention operation cannot be performed at a suitable time.

SUMMARY OF THE INVENTION

Accordingly, it is an object of the present invention to provide a microwave oven, and a method of controlling the same, which can suitably perform an overheating prevention operation by increasing/decreasing a cooking time according to cooking conditions.

Another object of the present invention is to provide a microwave oven, and method of controlling the same, which can improve a cooking performance by recovering an original output power level in response to cancellation of an overheating prevention operation.

Additional objects and advantages of the invention will be set forth in part in the description which follows and, in part, will be obvious from the description, or may be learned by practice of the invention.

To achieve the above and other objects of the present invention, there is provided a microwave oven having a magnetron which outputs microwaves to cook food, an input unit which receives a target cooking time and an output power level, a high voltage transformer which supplies a high voltage to the magnetron, a power switch which selectively supplies/intercepts power to the high voltage transformer, and a control unit which increases a cooking time in response to a cooking mode which drives the magnetron, decreases the cooking time in response to a stop mode which stops the driving of the magnetron, and manages the output power level by controlling the power switch according to the increased or decreased cooking time.

In the microwave oven of the present invention, the input unit includes a pause key which temporarily stops the driving of the magnetron, and the control unit decreases the cooking time in response to a pause mode of the pause key which is recognized as the stop mode.

In the microwave oven of the present invention, the control unit compulsorily decreases the output power level in response to the cooking time being equal to or greater than a preset overheating prevention time, and recovers the output power level in response to elapse of a predetermined period of time after the output power level is decreased.

In the microwave oven of the present invention, the input unit includes a cancel key which stops the driving of the magnetron, and the control unit stores the cooking time in response to manipulation of the cancel key to stop the magnetron, and counts a new cooking time from the stored cooking time in response to the magnetron being driven according to new cooking conditions input through the input unit.

Additionally, the present invention provides a microwave oven having a heating unit which cooks food, a setting unit which obtains a target cooking time and an output power level, a driving unit which drives the heating unit, and a control unit which increases a cooking time in response to an operation of the heating unit, decreases the cooking time in response to the operation of the heating unit being stopped, and performs an overheating prevention operation by controlling the driving unit to decrease the output power level in response to the increased/decreased cooking time being equal to or greater than a preset time.

In the microwave oven of the present invention, the control unit recovers the output power level in response to elapse of a predetermined time after the output power level is decreased.

Furthermore, the present invention provides a method of controlling a microwave oven having a magnetron which outputs microwaves to cook food, the method comprising setting cooking conditions including a target cooking time and an output power level, performing a cooking operation according to the set cooking conditions, increasing or decreasing a cooking time according to whether the magnetron is driven, decreasing the output power level by a predetermined value in response to the cooking time being equal to or greater than a set time, and recovering the output power level in response to elapse of a predetermined time after the decreasing of the output power level.

The increasing or decreasing of the cooking time comprises increasing the cooking time in response to a cooking mode which drives the magnetron, and decreasing the cooking time in response to a stop mode which stops the driving of the magnetron.

The cooking time is decreased in response to a pause mode, which temporarily stops the cooking operation, and is recognized as the stop mode.

The method further comprises storing the cooking time in response to a cancel mode which cancels the cooking operation, and counting a new cooking time from the stored cooking time in response to performing another cooking operation according to newly set cooking conditions.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
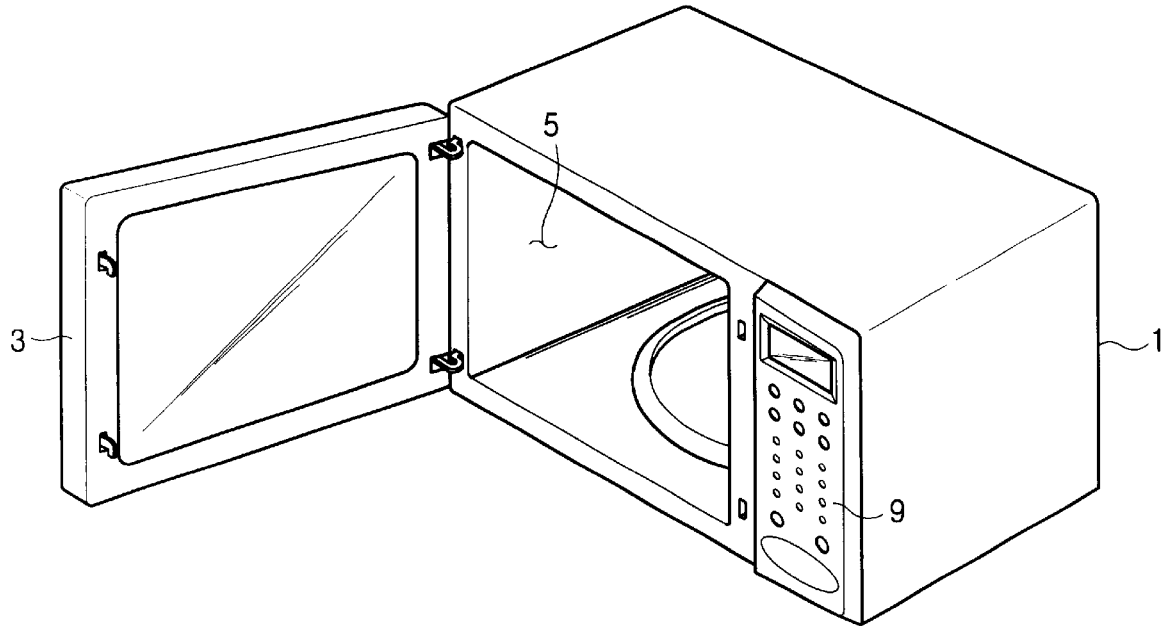
FIG. 1 is a perspective view of a conventional microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
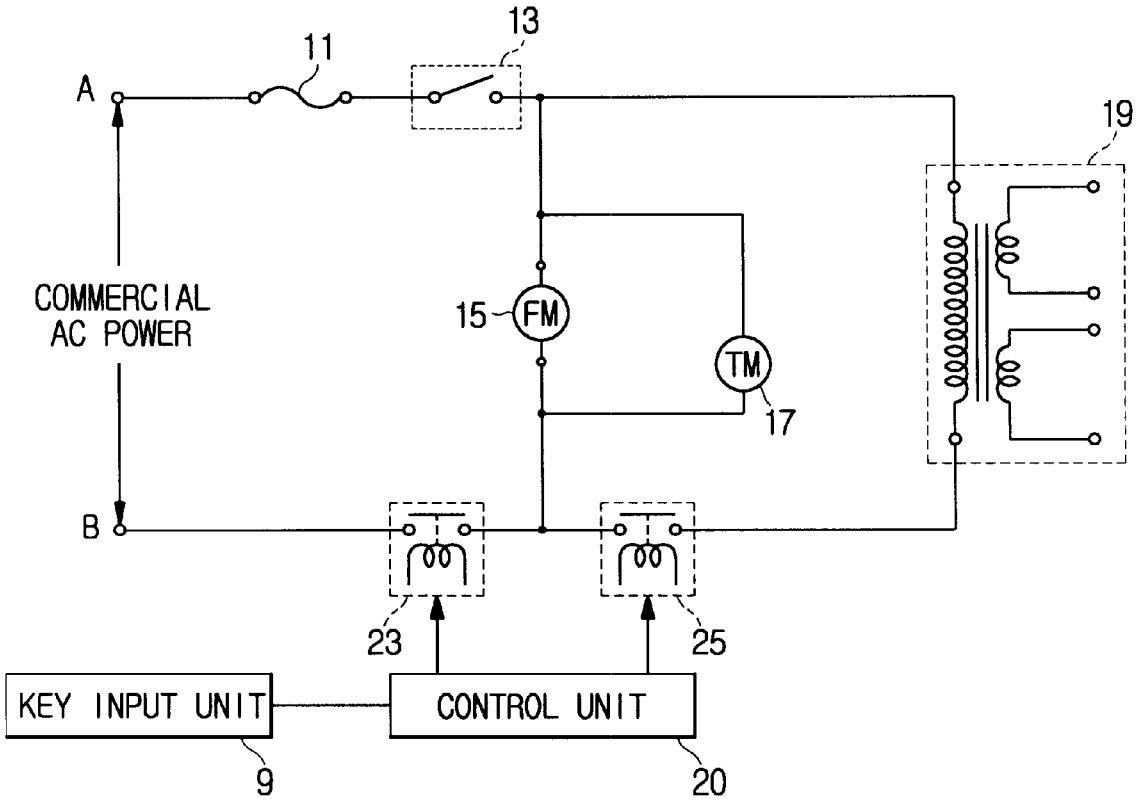
FIG. 2 is a circuit diagram illustrating the construction of a microwave oven according to an embodiment of the present invention.

FIG. 2 shows a circuit diagram illustrating the construction of a microwave oven according to an embodiment the present invention, to which a manner of controlling a power relay to control an output power level is applied.

Referring to FIG. 2, a fan motor 15, which drives a cooling fan (not shown), is connected in parallel with power terminals A and B which supply commercial alternating current (AC) power. The cooling fan cools various electrical parts in a machine room of the microwave oven. A tray motor 17, which rotates a tray (not shown) in a cooking chamber of the microwave oven, is connected in parallel with the fan motor 15. The power terminals A and B are connected to both ends of a high voltage transformer 19 to supply a high voltage to a magnetron (not shown).

A fuse 11 and a door switch 13, which is turned on/off according to opening/closing of a door (not shown), are connected in series between the power terminal A and one end of the fan motor 15. A main relay 23 is disposed between the power terminal B and the other end of the fan motor 15. A power relay 25 is disposed between the fan motor 15 and a primary coil of the high voltage transformer 19.

A control unit 20 outputs switching control signals to turn on/off the main relay 23 and the power relay 25 in response to a key signal input from the key input unit 9. The main relay 23 is switched to an on or off position in response to the corresponding switching control signal output from the control unit 20, so as to supply or intercept the commercial AC power supplied through the power terminals A and B to the fan motor 15, the tray motor 17 and the high voltage transformer 19.

Additionally, the power relay 25 is switched to an on or off position in response to the corresponding switching control signal output from the control unit 20, so as to supply or intercept the commercial AC power supplied through the power terminals A and B to the high voltage transformer 19.

The control unit 20 includes a counter (not shown) to count a cooking time, increases/decreases the cooking time according to cooking conditions, and performs an overheating prevention operation based on the increased/decreased cooking time. An operation of the control unit 20 is described in detail with reference to FIGS. 2–3.

Figure 3:
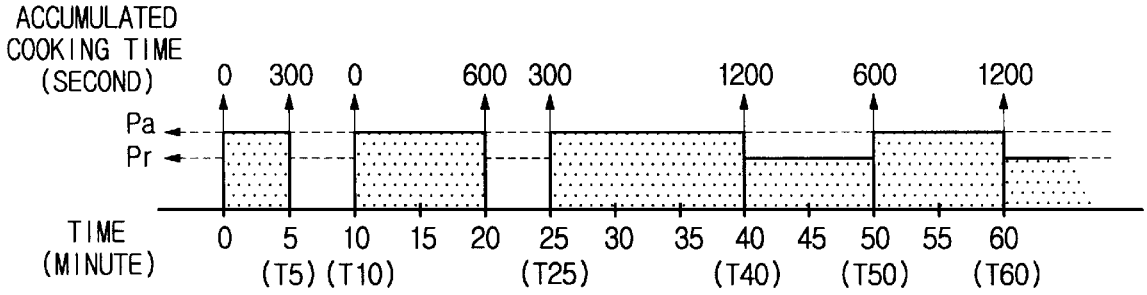
FIG. 3 is a block chart illustrating the operations of counting a cooking time and controlling an output power level on the basis of the counted cooking time in accordance with the present invention.

FIG. 3 shows a block chart illustrating operations of counting the cooking time, and controlling an output power level based on the counted cooking time.

In FIG. 3, lower numbers represent elapsed times, in minutes, according to the progress of a cooking operation, while upper numbers represent elapsed times, in seconds, according to the progress of the cooking operation. The lower and upper numbers represent cooking times accumulated in the counter of the control unit 20.

The cooking time accumulated in the counter of the control unit 20 increases where an output power level is equal to or greater than a preset reference output power level (for example, 70%), while the cooking time decreases where the output power level is less than the reference output power level. For example, where the counter counts a cooking time from the beginning of the cooking operation, and a pause key is manipulated at a point T5, where 5 minutes have elapsed, the power relay 25 is turned off by the control unit 20. That is, the cooking operation enters a cooling stage, and the counter decreases a current counted value of 300 seconds, in for example, seconds.

Where the pause key is re-manipulated at a point T10, where 10 minutes have elapsed, and the pausing of the cooking operation is canceled, the power relay 25 is turned on by the control unit 20 and the cooking operation is continued. At this time, the counter increases a current counted value of 0, in for example, seconds.

Where a cancel key is manipulated at a point T20, where 20 minutes have elapsed, the power relay 25 is turned off by the control unit 20. That is, the cooking operation enters another cooling stage, and the counter decreases a current counted value of 600 seconds.

Where new cooking conditions are set at a point T25, where 25 minutes have elapsed, and the power relay 25 is turned on by the control unit 20, a new cooking operation is carried out according to the newly set cooking conditions. Therefore, the counter increases a current counted value of 300 seconds. Where the increased counted value of the counter reaches a preset overheating prevention time (for example, 1200 seconds), that is, where the counted value accumulated in the counter at a point T40, where 40 minutes have elapsed, is 1200 seconds, the control unit 20 decreases the output power level to less than the preset reference output power level (for example, 70%) by compulsorily shortening the switching-on time (for example, to less than 21 seconds) of the power relay 25 in a predetermined period (for example, 30 seconds) so as to prevent overheating of the microwave oven. Accordingly, the counter decreases a current counted value of 1200 seconds.

After the output power level is compulsorily decreased, where a set cooling period (for example, 10 minutes) has elapsed, that is, at a point T50, where 50 minutes have elapsed, the control unit 20 recovers the output power level, which is initially set, by lengthening the switching-on time of the power relay 25. Accordingly, the counter increases a current counted value of 600 seconds. Where the increased counted value of the counter reaches the preset overheating prevention time (1200 seconds), that is, if the counted value accumulated in the counter at a point T60, where 60 minutes have elapsed, is 1200 seconds, the control unit 20 again decreases the output power level to less than the preset reference output power level (70%) by compulsorily shortening the switching-on time (for example, to less than 21 seconds) of the power relay 25 in a predetermined period (for example, 30 seconds) so as to prevent the overheating. Accordingly, the counter decreases a current counted value of 1200, in for example, seconds.

As described above, the operations of increasing/decreasing a cooking time by the counter according to cooking conditions are performed until a cooking time reaches a set cooking end time. If the cooking time reaches the set cooking end time and the cooking operation ends, the counter is set to an initial value.

Figure 4:
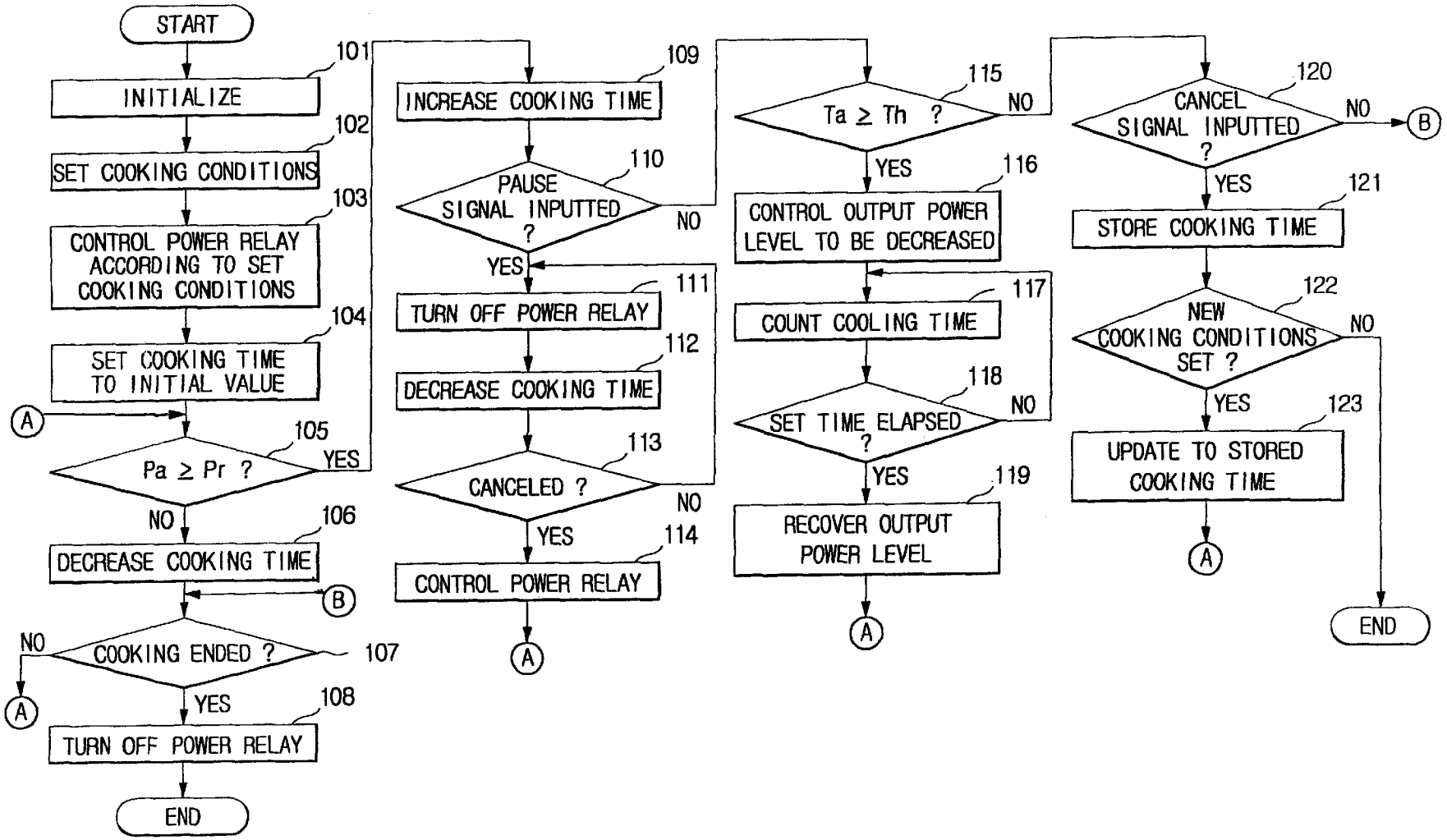
FIG. 4 is a flowchart of a method of controlling the microwave oven shown in FIG. 2, according to the present invention.

Hereinafter, a method of controlling the microwave oven of the present invention is described with reference to a flowchart of FIG. 4.

The control unit 20 is supplied with power and performs an initializing operation in operation 101. A user may set cooking conditions (for example, target cooking time, an output power level, etc.) using the key input unit 9 in operation 102. Alternatively, where the user selects a cooking menu item, the cooking conditions for the cooking menu item are automatically set in the operation 102.

The control unit 20 then turns on the main relay 23 so as to perform a cooking operation according to the set cooking conditions, and controls the switching-on time of the power relay 25 in a given period (for example, 30 seconds) so as to obtain the set output power level in operation 103.

At this time, the counter of the controller 20 sets a cooking time to an initial value of 0 in operation 104. The control unit 20 determines whether the set output power level Pa is equal to or greater than a preset reference output power level Pr (for example, 70% of a maximum output power level) in operation 105. Where the set output power level Pa is determined to be less than the reference output power level Pr, the counted value of the counter is decreased in operation 106. The control unit 20 then determines whether the counted value of the counter has reached a cooking end time preset to end the cooking operation in operation 107. Where the counted value is determined to not have reached the cooking end time, the process returns to the operation 105. Where the counted value is determined to have reached the cooking end time, the control unit 20 stops the cooking operation by turning off the power relay 25 in operation 108.

Where the set output power level Pa is equal to or greater than the reference output power level Pr in the operation 105, the counted value of the counter is increased in operation 109. The control unit 20 then determines, for example, whether a pause signal has been input from the key input unit 9, that is, whether the user has manipulated a pause key to temporarily stop the cooking operation in operation 110. Where the pause signal has been input, the control unit 20 turns off the power relay 25 in operation 111, and allows the counter to decrease the counted value in operation 112. The reason for this is that the pausing of the cooking operation corresponds to a process of cooling the electrical parts, including the high voltage transformer 19, by external air.

The control unit 20 determines whether the pausing has been canceled in operation 113. Where the pausing has been canceled, the control unit 20 controls the switching-on time of the power relay 25 in a given period (for example, 30 seconds) so as to obtain the set output power level in operation 114, and returns to the operation 105 to count the cooking time.

Where the pausing has not been canceled in the operation 113, the process returns to the operation 111.

Where the pause signal has not been input in the operation 110, the control unit 20 determines whether the counted value of the counter, that is, an accumulated cooking time Ta, is equal to or greater than an overheating prevention time Th (for example, 1200 seconds) preset to prevent overheating of the microwave oven in operation 115. Where the accumulated cooking time Ta is equal to or greater than the overheating prevention time Th, the control unit 20 controls the power relay 25 to compulsorily decrease the output power level to less than the reference output power level (for example, less than 70% of a maximum output power) in operation 116.

Where the output power level is compulsorily decreased, the cooking operation enters a cooling stage, and the cooling period is counted. In this case, the counting of the cooling period is performed by decreasing the counted value of the counter which counts the cooking time rather than using an additional counter, in operation 117.

The control unit 20 determines whether the cooling period has reached a set time (for example, 10 minutes) based on the decreased counted value in operation 118. Where the cooling period has not reached the set time, that is, where the counted value is not decreased by the set time (10 minutes), the process returns to the operation 117.

Where the cooling period has reached the set time, that is, where the counted value is decreased by the set time (10 minutes), the control unit 20 recovers the output power level set in the cooking conditions in operation 119. For example, the output power level is initially set to 90%, and decreased to 60% for the cooling period of 10 minutes. Where the cooling period has elapsed, the output power level is recovered to 90%, which is the initial output power level.

Where the accumulated cooking time Ta is less than the overheating prevention time Th in the operation 115, the control unit 20 determines whether a cancel signal has been input from the key input unit 9. That is, the control unit 20 determines whether the user has manipulated a cancel key to cancel the current cooking operation in operation 120. Where the cancel signal has been input, the control unit 20 stores the cooking time accumulated in the counter in its internal memory in operation 121, and determines whether new cooking conditions are set through the key input unit 9 in operation 122. Where the new cooking conditions are set, the control unit 20 updates, for example, a cooking time to the stored cooking time in operation 123, and returns to the operation 105 so as to start counting from the updated cooking time with respect to the cooking operation performed according to the new cooking conditions.

Where the new cooking conditions are not set in the operation 122, the process ends. Where the cancel signal has not been input in the operation 120, the process returns to the operation 107.

As described above, the present invention provides a microwave oven, and a method of controlling the same, which counts a cooking time in consideration of cooking conditions. The microwave oven decreases an output power level in response to the counted cooking time being equal to or greater than a preset overheating prevention time, and compulsorily recovers the output power level to perform the remaining cooking operation in response to elapse of a cooling period. Accordingly, the entire cooking time is reduced, and the cooking performance is improved. Furthermore, since the microwave oven counts the cooking time where an actual cooking operation is performed, an unnecessary overheating prevention operation can be suppressed. The microwave oven of the present invention performs the overheating prevention operation at a suitable time.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a magnetron which outputs microwaves to cook food;

an input unit which receives a target cooking time and an output power level;

a high voltage transformer which supplies a high voltage to the magnetron;

a power switch which selectively supplies/intercepts power to the high voltage transformer; and a control unit which increases a cooking time in response to a cooking mode which drives the magnetron, decreases the cooking time in response to a stop mode which stops the driving of the magnetron, and manages the output power level by controlling the power switch according to the increased or decreased cooking time.

2. The microwave oven according to claim 1, wherein:

the input unit includes a pause key which temporarily stops the driving of the magnetron, and the control unit decreases the cooking time in response to a pause mode of the pause key which is recognized as the stop mode.

3. The microwave oven according to claim 1, wherein the control unit compulsorily decreases the output power level in response to the cooking time being equal to or greater than a preset overheating prevention time, and recovers the output power level in response to elapse of a predetermined period of time after the output power level is decreased.

4. The microwave oven according to claim 3, wherein:

the control unit decreases the output power level by decreasing a switching-on time of the power switch relative to a switching-off time of the power switch in a determined time period, and recovers the output power level by increasing the switching-on time of the power switch relative to the switching-off time of the power switch in the determined time period, and the power switch supplies the power to the high voltage transformer during the switching-on time and intercepts the power to the high voltage transformer during the switching-off time.

5. The microwave oven according to claim 4, wherein the control unit decreases the output power level so as to prevent overheating of the microwave oven.

6. The microwave oven according to claim 3, the predetermined period of time is based on a decreased counted value of the cooking time.

7. The microwave oven according to claim 1, wherein:

the input unit includes a cancel key which stops the driving of the magnetron, and the control unit stores the cooking time in response to manipulation of the cancel key to stop the magnetron, and counts a new cooking time from the stored cooking time in response the magnetron being driven according to new cooking conditions input through the input unit.

8. The microwave oven according to claim 1, wherein:

the control unit manages the output power level by increasing/decreasing a switching-on time of the power switch relative to a switching-off time of the power switch in a determined time period, and the power switch supplies the power to the high voltage transformer during the switching-on time and intercepts the power to the high voltage transformer during the switching-off time.

9. A cooking apparatus, comprising:

a heating unit which cooks food;

a setting unit which obtains a target cooking time and an output power level;

a driving unit which drives the heating unit; and a control unit which increases a cooking time in response to an operation of the heating unit, decreases the cooking time in response to the operation of the heating unit being stopped, and performs an overheating prevention operation by controlling the driving unit to decrease the output power level in response to the increased/decreased cooking time being equal to or greater than a preset time.

10. The cooking apparatus according to claim 9, wherein the control unit recovers the output power level in response to elapse of a predetermined time after the output power level is decreased.

11. The cooking apparatus according to claim 10, wherein:

the control unit recovers the output power level by increasing a switching-on time of the driving unit relative to a switching-off time of the driving unit in a determined time period, and the driving unit interrupts driving of the heating unit during the switching-off time.

12. The cooking apparatus according to claim 10, wherein the predetermined period of time is based on a decreased counted value of the cooking time.

13. The cooking apparatus according to claim 9, wherein:

the setting unit includes a pause key which temporarily stops the operation of the heating unit, and the control unit decreases the cooking time in response to a manipulation of the pause key to stop the operation of the heating unit.

14. The cooking apparatus according to claim 9, wherein:

the setting unit includes a cancel key which stops the operation of the heating unit, and the control unit stores the cooking time in response to manipulation of the cancel key to stop the operation of the heating unit, and counts a new cooking time from the stored cooking time in response the heating unit being operated according to new cooking conditions input through the input unit.

15. The cooking apparatus according to claim 9, wherein:

the control unit decreases the output power level by decreasing a switching-on time of the driving unit relative to a switching-off time of the driving unit in a determined time period, and the driving unit drives the heating unit during the switching-on time.

16. A method of controlling a microwave oven having a magnetron which outputs microwaves to cook food, the method comprising:

setting cooking conditions including a target cooking time and an output power level;

performing a cooking operation according to the set cooking conditions;

increasing or decreasing a cooking time according to whether the magnetron is driven;

decreasing the output power level by a predetermined value in response to the cooking time being equal to or greater than a set time; and recovering the output power level in response to elapse of a predetermined time after the decreasing of the output power level.

17. The method according to claim 16, wherein the increasing or decreasing of the cooking time comprises increasing the cooking time in response to a cooking mode which drives the magnetron, and decreasing the cooking time in response to a stop mode which stops driving of the magnetron.

18. The method according to claim 17, wherein the cooking time is decreased in response to a pause mode, which temporarily stops the cooking operation and is recognized as the stop mode.

19. The method according to claim 17, further comprising:

storing the cooking time in response to a cancel mode which cancels the cooking operation; and counting a new cooking time from the stored cooking time in response to performing another cooking operation according to newly set cooking conditions.

20. The method according to claim 16, wherein the decreasing of the output power level comprises decreasing a switching-on time of the magnetron relative to a switching-off time of the magnetron in a determined time period.

21. The method according to claim 20, wherein the decreasing of the output power level further comprises decreasing the cooking time in response to the switching-off time of the magnetron.

22. The method according to claim 16, wherein the recovering of the output power level comprises increasing a switching-on time of the magnetron relative to a switching-off time of the magnetron in a determined time period.

23. A cooking apparatus comprising:

a heating unit which cooks food; and a control unit which increases a counted time in response to an output power level of the heating unit being equal to or greater than a preset reference power level, decreases the counted time in response to the output power level being less than the preset reference power level, and decreases the output power level in response to the counted time being equal to or greater than a predetermined period of time.

24. The cooking apparatus according to claim 23, wherein the control unit recovers the output power level in response to elapse of a preset time after the output power level is decreased.

* * * * *